US007775953B2

(12) United States Patent
Wang

(10) Patent No.: US 7,775,953 B2
(45) Date of Patent: Aug. 17, 2010

(54) ROTATING PLATE STRUCTURE OF A WAIST TWIST MACHINE

(76) Inventor: Loao Wang, No. 1, Lane 233, Sec. 2, Charng Long Rd, Taiping (TW) 411

( * ) Notice: Subject to any disclaimer, the term of this patent is extended or adjusted under 35 U.S.C. 154(b) by 0 days.

(21) Appl. No.: 12/333,285

(22) Filed: Dec. 11, 2008

(65) Prior Publication Data

US 2010/0152006 A1 Jun. 17, 2010

(51) Int. Cl.
*A63B 22/14* (2006.01)
*A63B 22/04* (2006.01)

(52) U.S. Cl. ..... 482/147; 482/52; 482/146

(58) Field of Classification Search ..... 482/52, 482/70, 79, 80, 146, 147, 62, 71
See application file for complete search history.

(56) References Cited

U.S. PATENT DOCUMENTS 5,453,065 A * 9/1995 Lien et al. ..... 482/52
5,645,512 A * 7/1997 Yu ..... 482/53
7,104,928 B1 * 9/2006 Liu et al. ..... 482/52
7,198,590 B1 * 4/2007 Nicholas ..... 482/71
7,338,414 B1 * 3/2008 Hsiung ..... 482/71
7,455,623 B2 * 11/2008 Wang ..... 482/52

* cited by examiner

*Primary Examiner*—Loan H Thanh
*Assistant Examiner*—Allana Lewin

(57) ABSTRACT

A waist twist machine having a base frame, a rear support, and a front upright rod with a handle at the top thereof. A crossbar is positioned near the center of the base frame. A rotating rod is pivotally disposed at the top of the crossbar. A rotating plate assembly is pivotally connected to the rotating rod. The rotating plate assembly includes a front rotating arm, a rear rotating arm, and two foot plates that are pivotally connected to one another. The bottom of the front and the rear end of the foot plates is pivotally attached to the front and rear rotating arms. The front and rear rotating arms each include a pivoting portion at the center thereof. The pivoting portions are pivotally coupled to both ends of the rotating rod. As a result, the front and rear rotating arms create a rotational deformation due to the action of the pivoting points when the foot plates are subject to force and are rotated. In this way, both of the foot plates create more rotational angles.

1 Claim, 4 Drawing Sheets

ROTATING PLATE STRUCTURE OF A WAIST TWIST MACHINE

BACKGROUND OF THE INVENTION

1. Fields of the Invention

The invention relates to a rotating plate structure of a waist twist machine, and more particularly, to a structure that employs the rotational deformation of a rotating plate assembly such that both of the foot plates create more rotational angles. In this way, the waist-twisting exercise effect is enhanced.

2. Description of the Related Art

As we all know, the so-called "waist twist machine" is a fitness device by which the user may twist his waist and his abdominal muscles to achieve the unique exercise effect. At present, the conventional similar devices almost employ a rotating disc as a structural basis on which a user stands to apply force for its rotation. In use, the user has to hold a fixed handle with his both hands so that his upper body is positioned at a certain angle. At this point, the user twists the lower part of his body to the left and right sides. In this way, the fitness exercise of the waist and the abdominal part is achieved.

The use of the fitness device is extremely simple. Moreover, there is no special design in its structure. When we take a careful study of its exercise effect, it is not difficult to find that the rotational angle of the rotating disc is subject to the force applied by the user himself. Therefore, if the lower body of the user twists at an angle of 20°, the rotational angle of the rotating disc is also 20°. In other words, the twisting angle is not increased and the fitness effect is not enhanced by the mechanical structure.

SUMMARY OF THE INVENTION

An object of the invention is to provide a rotating plate structure of a waist twist machine that includes a rotating plate assembly for creating a rotational deformation. In this way, the foot plates create more rotational angles by use of the mechanical structure when they are subject to force and are rotated. Moreover, more body twisting exercise effect is achieved.

According to the invention, a rotating plate structure of a waist twist machine employs a crossbar and a rotating rod in match of the a rotating plate assembly such that both foot plates create a rotational deformation after the front and rear arms are subject to force and are rotated, thereby creating more rotational angles.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

The present invention will now be described in more detail hereinafter with reference to the accompanying drawings that show various embodiments of the invention.

Figure 1:
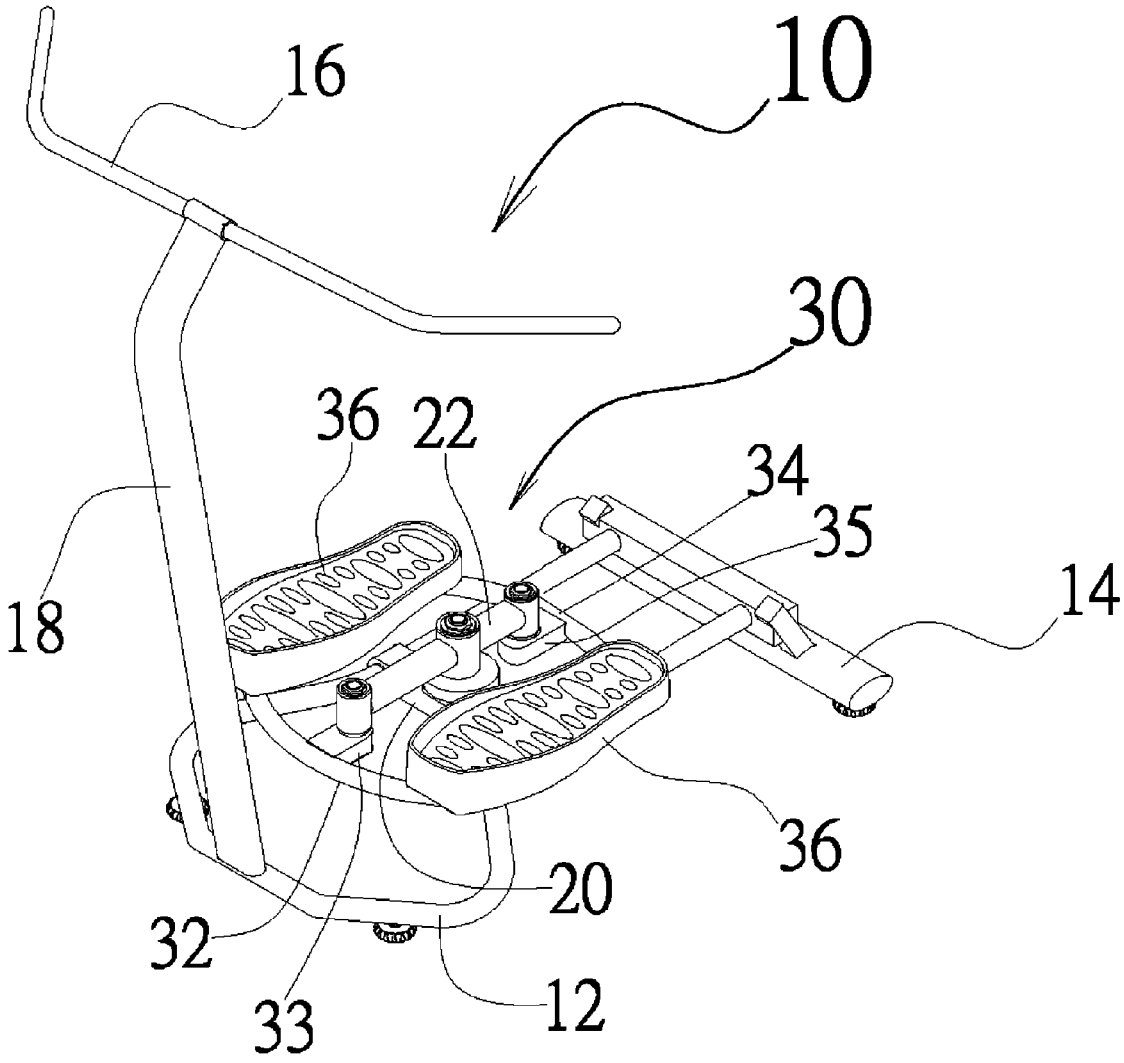
FIG. 1 is a perspective view of a preferred embodiment of the invention.
Figure 2:
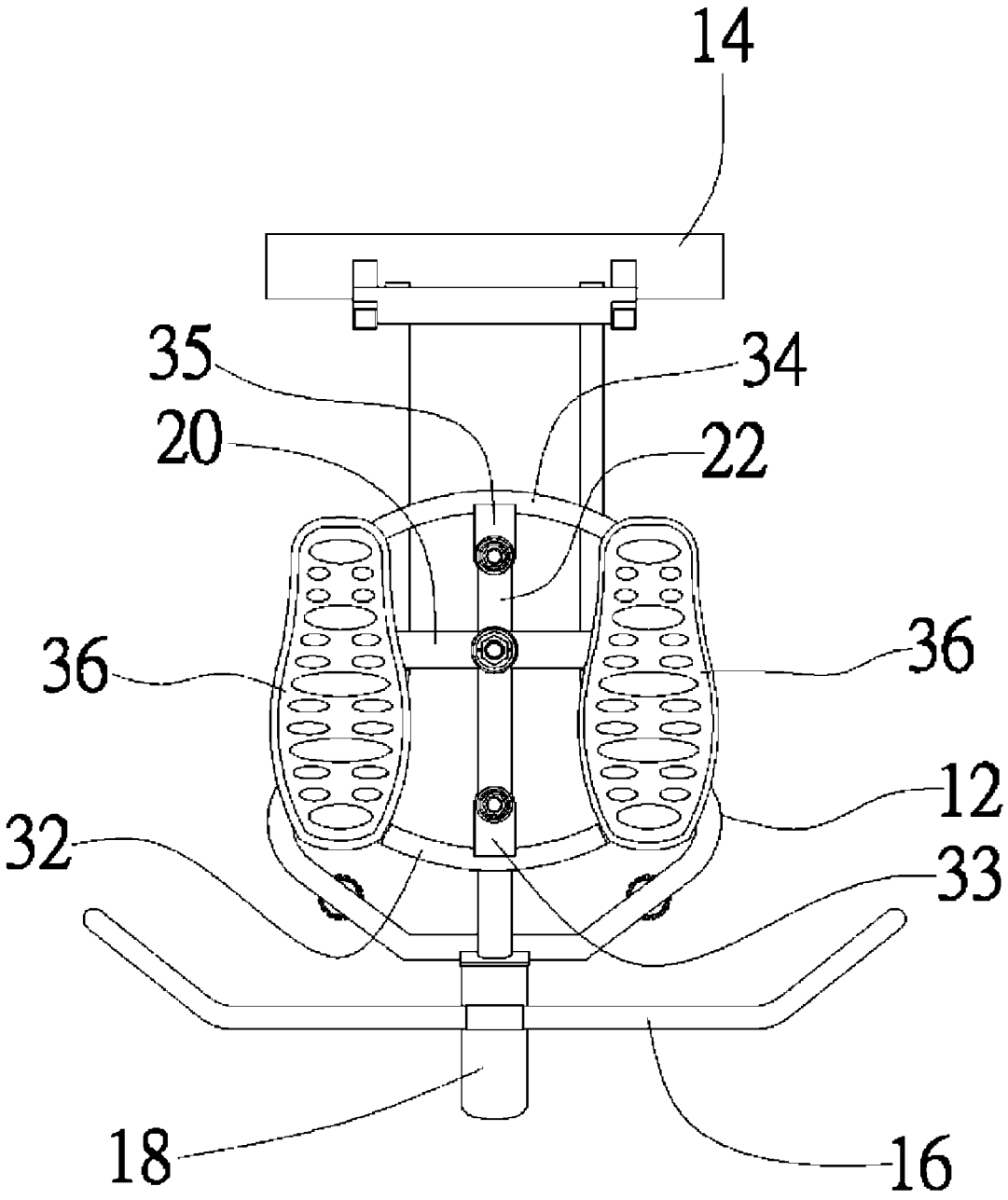
FIG. 2 is a top view of the preferred embodiment of the invention according to FIG. 1.

Referring to FIGS. 1 and 2, a waist twist machine 10 in accordance with a preferred embodiment of the invention includes a base frame 12, a rear support 14, and a front upright rod 18 with a handle 16 at the top thereof. A crossbar 20 is positioned near the center of the base frame 12. A rotating rod 22 is pivotally disposed at the top of the crossbar 20. A rotating plate assembly 30 is pivotally connected to the rotating rod 22.

Figure 3:
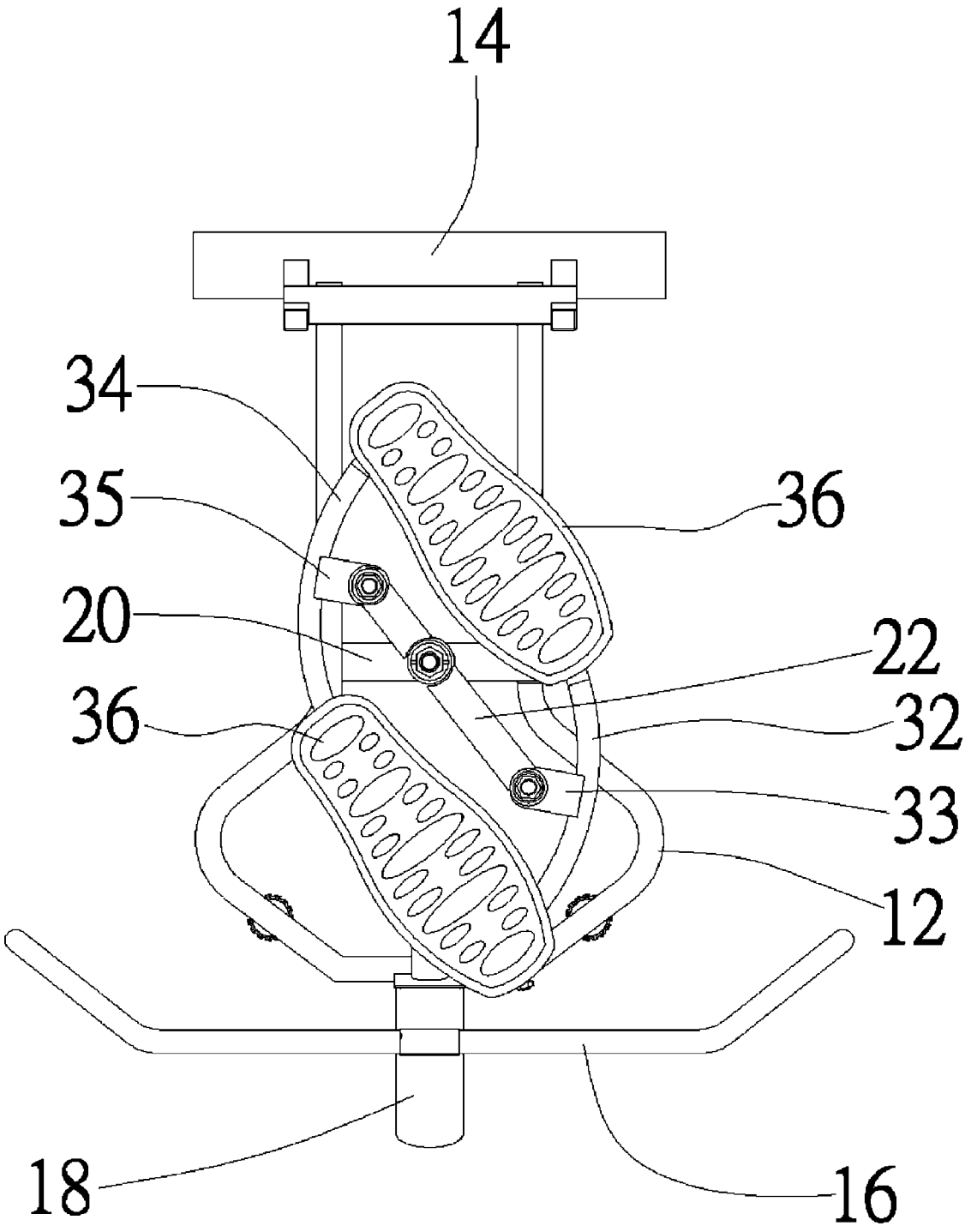
FIG. 3 is a top view of the preferred embodiment of the invention according to FIG. 2 wherein the direction of the movement is illustrated.
Figure 4:
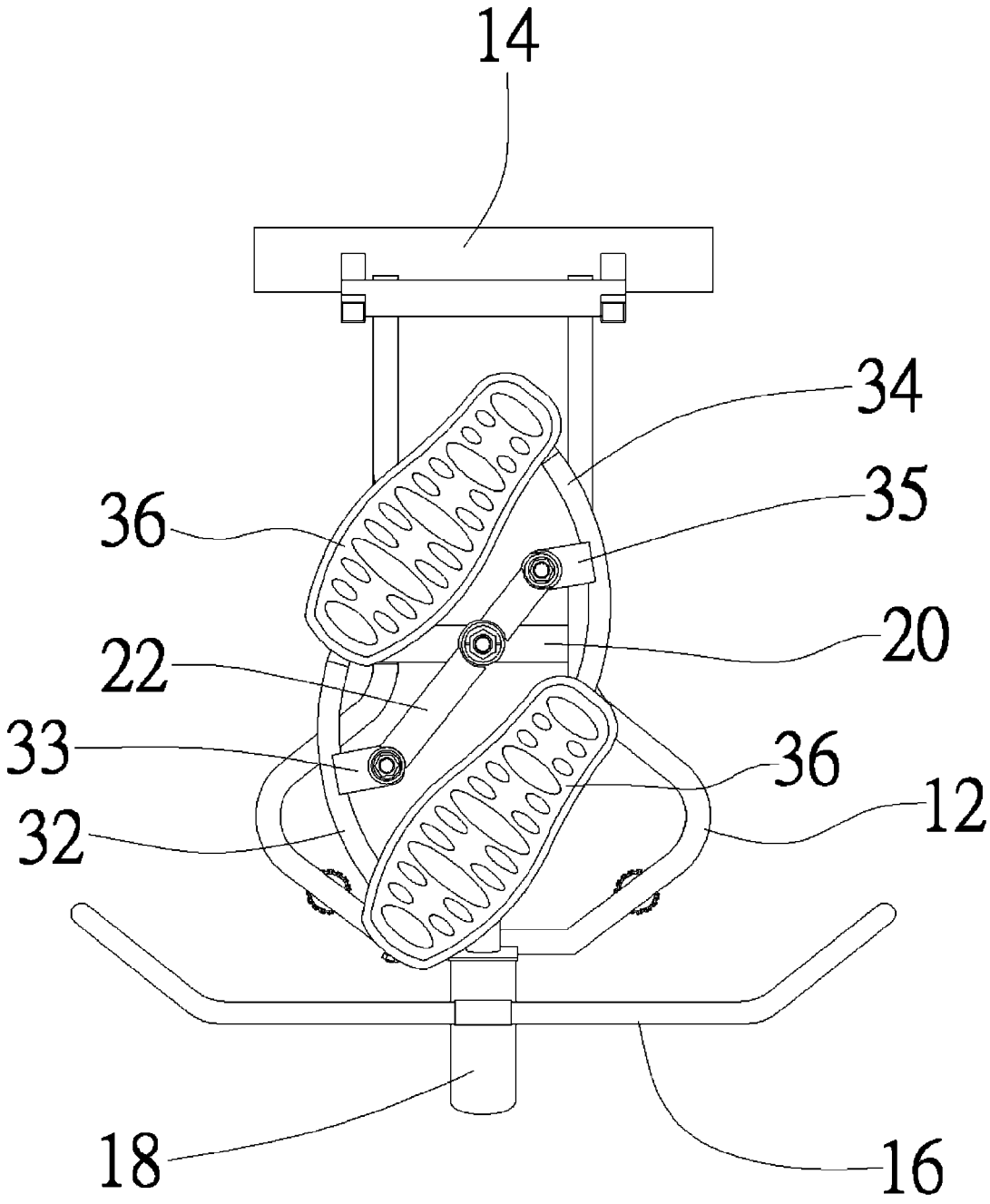
FIG. 4 is a top view of the preferred embodiment of the invention according to FIG. 3 wherein another direction of the movement is illustrated.

As shown in FIGS. 3 and 4, the rotating plate assembly 30 includes a front rotating arm 32, a rear rotating arm 34, and two foot plates 36 that are pivotally connected to one another. The bottom of the front and the rear end of the foot plates 36 is pivotally attached to the front and rear rotating arms 32, 34. The front and rear rotating arms 32, 34 each include a pivoting portion 33, 35 at the center thereof. The pivoting portions 33, 35 are pivotally coupled to both ends of the rotating rod 22. As a result, the front and rear rotating arms 32, 34 create a rotational deformation due to the action of the pivoting points when the foot plates 36 are subject to force and are rotated. In this way, both of the foot plates 36 create more rotational angles.

Based on the assembly of the above-mentioned components, the twisting angle of the foot plates 36 can be effectively increased. In this way, a better waist-twisting exercise effect can be achieved in addition to an easy use of the apparatus. Therefore, the use value is increased.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A rotating plate structure of a waist twist machine having:

a base frame, a rear support, a front upright rod with a handle at the top thereof, a crossbar positioned at the center of the base frame, a rotating rod wherein the rotating rod is pivotally connected at a midpoint of the rotating rod to a midpoint of the top of the crossbar, and a rotating plate assembly being pivotally connected to the rotating rod, wherein the rotating plate assembly includes a front rotating arm, a rear rotating arm, and two foot plates that are pivotally connected to one another, and wherein the bottom of the front and the rear end of each foot plate is pivotally attached to the front and the rear rotating arms, and wherein the front and rear rotating arms each include a pivoting portion at the center thereof, and wherein the pivoting portions are pivotally coupled to both ends of the rotating rod; therefore, the front and rear rotating arms create a rotational deformation due to the action of the pivoting points when the foot plates are subject to force and are rotated.

* * * * *